US006954975B2

(12) United States Patent
Dolinski

(10) Patent No.: US 6,954,975 B2
(45) Date of Patent: Oct. 18, 2005

(54) MAT RAMP SECUREMENT

(75) Inventor: Michael W. Dolinski, LaGrange, IL (US)

(73) Assignee: Superior Manufacturing Group, Inc., Chicago, IL (US)

( * ) Notice: Subject to any disclaimer, the term of this patent is extended or adjusted under 35 U.S.C. 154(b) by 141 days.

(21) Appl. No.: 10/238,495

(22) Filed: Sep. 10, 2002

(65) Prior Publication Data

US 2004/0045149 A1 Mar. 11, 2004

(51) Int. Cl.[7] ..... E04F 15/00

(52) U.S. Cl. ..... 29/428; 52/591.1; 52/592.1; 404/35; 404/39

(58) Field of Search ..... 29/415, 416, 428; 52/174, 175, 177, 591.1, 591.2, 592.1; 404/35, 39

(56) References Cited

U.S. PATENT DOCUMENTS

| | | | |
|---|---|---|---|
| 3,703,059 | A | 11/1972 | Kessler |
| 3,802,144 | A | 4/1974 | Spica |
| 3,909,996 | A | 10/1975 | Ettlinger, Jr. et al. |
| 4,143,194 | A | 3/1979 | Wihksne |
| 4,287,693 | A | 9/1981 | Collette |
| 4,373,306 | A | 2/1983 | Rech |
| 4,468,910 | A | 9/1984 | Morrison |
| 4,497,858 | A | 2/1985 | Dupont et al. |
| 4,596,729 | A | 6/1986 | Morrison |
| 4,642,946 | A | 2/1987 | Koch |
| 4,782,640 | A | 11/1988 | Scheiwiller |
| 4,973,505 | A | 11/1990 | Bielous |
| 5,131,709 | A | 7/1992 | Spica |
| 5,403,637 | A | 4/1995 | Pickard et al. |
| 5,446,937 | A | 9/1995 | Haskins |
| 5,486,392 | A | 1/1996 | Green |
| 5,490,821 | A | 2/1996 | Wu |
| 5,628,160 | A | 5/1997 | Kung |
| 5,630,304 | A | 5/1997 | Austin |
| 5,958,538 | A | 9/1999 | Kessler |
| 5,992,105 | A | 11/1999 | Kessler et al. |
| 6,042,915 | A | 3/2000 | Kessler |
| 6,127,015 | A | 10/2000 | Kessler |
| 6,128,881 | A | 10/2000 | Bue et al. |
| 6,352,757 | B1 | 3/2002 | Kessler et al. |
| 6,405,495 | B1 | 6/2002 | Kessler et al. |
| 2002/0020123 | A1 | 2/2002 | Kessler et al. |
| 2002/0034418 | A1 | 3/2002 | Koch |

FOREIGN PATENT DOCUMENTS

| | | | | |
|---|---|---|---|---|
| DE | 4033750 | A * | 4/1992 | ..... A63B/6/00 |

* cited by examiner

*Primary Examiner*—David P. Bryant
*Assistant Examiner*—Jermie E. Cozart
(74) *Attorney, Agent, or Firm*—Wildman, Harrold, Allen & Dixon LLP; Thomas J. Ring

(57) ABSTRACT

A ramp member is provided for attachment with an edge of a floor mat to facilitate transportation of an object from a floor to an upper surface of the mat. A tab is provided which extends from the ramp member and defines a plane. Two projections extend from the plane of the tab out of alignment with the plane. Additionally, two cavities are formed in the ramp member adapted for receiving at least one of the two projections therein. A method of connecting ramp members is also included.

37 Claims, 4 Drawing Sheets

MAT RAMP SECUREMENT

FIELD OF THE INVENTION

This invention relates to a ramp for abutment with an edge of a floor mat to facilitate transportation of an object from a floor to an upper surface of the mat.

DETAILED DESCRIPTION

Figure 1:
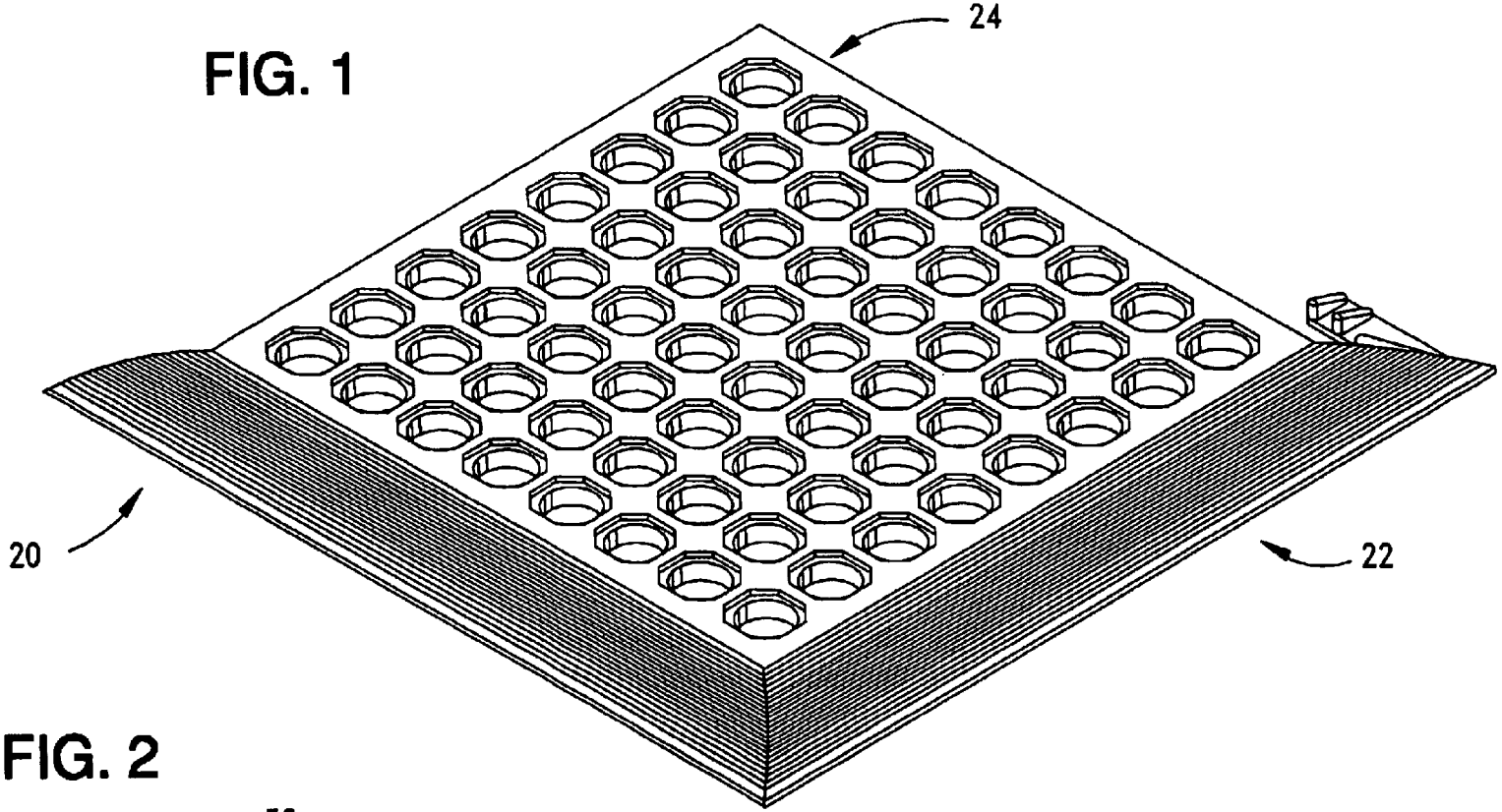
FIG. 1 is a perspective view of ramp members of the present invention coupled to a mat.
Figure 2:
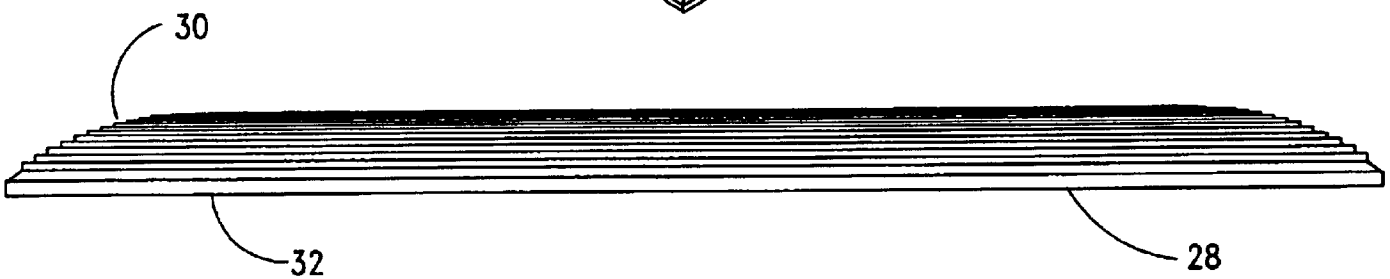
FIG. 2 is a front elevational view of a ramp member of the present invention.
Figure 3:
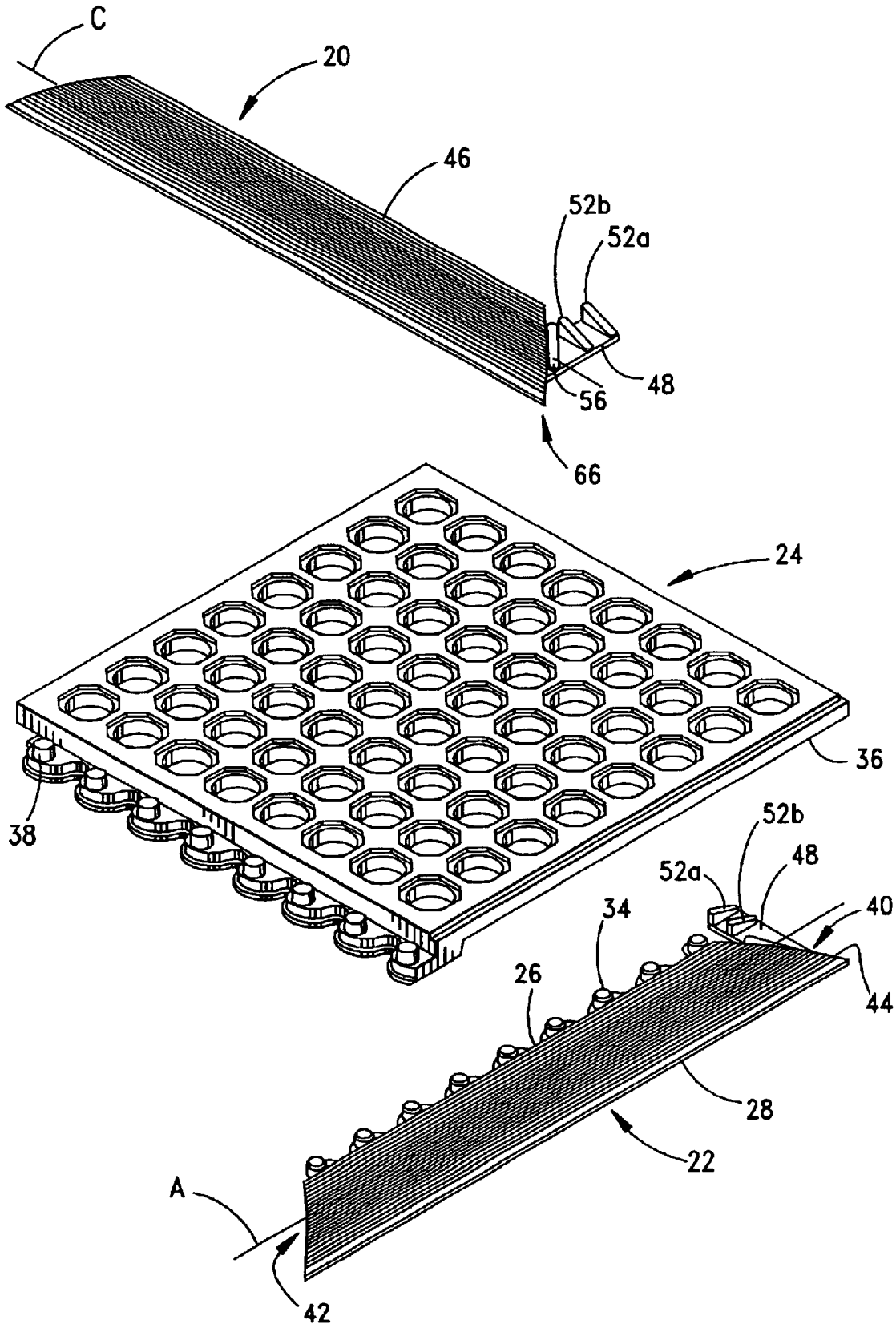
FIG. 3 is an exploded view of the ramp members and mat shown assembled in FIG. 1.

Referring now to the drawings, FIGS. 1–3 show ramp members 20 and 22 adapted for attachment to an edge of a floor mat 24. Ramp members 20 and 22 are utilized to provide a gradual inclination from a floor surface to an upper surface of floor mat 24, thereby removing abrupt changes in elevation between the surfaces.

Referring to ramp member 22 of FIGS. 2 and 3, ramp member 22 has a mat attachment edge 26, a floor edge 28, a top surface 30 into which the ramp is incorporated and a bottom surface 32 which makes contact with a floor or other surface on which the mat and ramp members are to be placed.

As seen in FIG. 3, a series of upwardly-extending bosses 34 may be formed in mat attachment edge of ramp member

22. Bosses 34 are configured to project and secure into corresponding cavities (not shown) in bottom side 36 of mat 24. Alternatively, the attachment edge ramp member 20 incorporate a series of cavities (not shown) formed on the bottom side of ramp member 20 for receiving therein corresponding ones of a series of bosses 38 formed in mat 24.

For simplicity, the features of ramp member 22 will be discussed in detail. It is understood that the features discussed in the following description may be common to either of ramp members 20 or 22, and that the main difference between ramp members 20 and 22 shown in FIG. 3 is the provision of bosses 34 in mat attachment edge 26 of ramp member 22, and the provision of cavities (not shown) in mat attachment edge 46 of ramp member 20 for receiving mat bosses 38 therein. In FIG. 3, ramp member 22 includes bosses 34 for projecting into cavities in bottom side of mat 24, and ramp member 20 has cavities incorporated into its bottom surface for receiving therein bosses 38 formed in mat 24.

In one embodiment, ramp member 22 is longitudinal and has a first end 40, a second end 42 opposite first end 40 and a longitudinal axis A. First end 40 may include an edge 44 formed at an acute angle with respect to longitudinal axis A. Edge 44 is configured for positioning adjacent and/or in abutment with an edge of an end portion of another ramp member, in a manner to be described in detail later. One example is demonstrated in FIG. 1. Angled edge 44 may form a 45 degree angle with longitudinal axis A. As seen in FIG. 2, top surface 30 slopes upward from a floor or other resting surface toward mat attachment edge 26. Ramp member 22 may be formed from any moldable material having properties suitable for a desired application of the ramp. For example, a plastic or rubber compound possessing sufficient mechanical toughness and chemical resistance may be used to handle domestic, commercial or even industrial applications.

Figure 4:
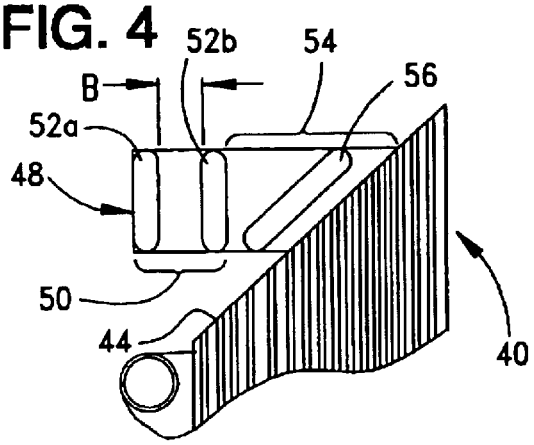
FIG. 4 is a partial top plan view of a first end of a ramp member of the present invention showing a tab formed on the ramp member end.
Figure 5:
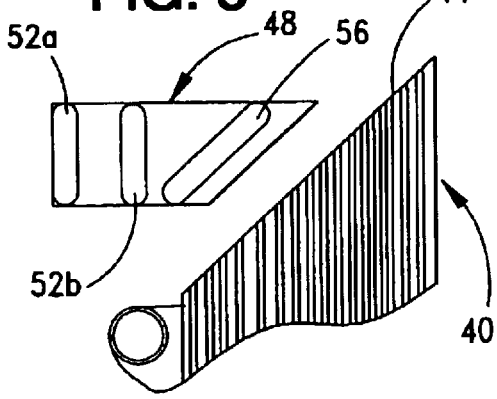
FIG. 5 is a partial top plan view of the ramp member end shown in FIG. 4 showing the tab detached from the ramp member end.
Figure 6:
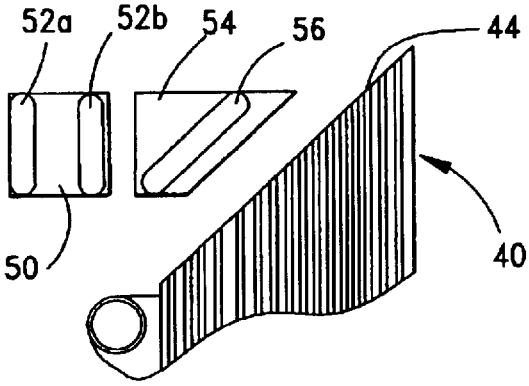
FIG. 6 is a partial top plan view of the ramp member end shown in FIG. 5 showing a first portion of the tab detached from a second portion of the tab.

Referring to FIGS. 3 and 4, a tab, generally designated 48, projects in a first direction from ramp member first end 40. Generally, tab 48 is formed unitarily with ramp member 22 and may extend from first end angled edge 44. As seen in FIGS. 4–6 and 9–10A, tab 48 comprises a first tab portion 50 from which first and second projections 52*a*, 52*b* extend and a second tab portion 54 connecting first tab portion 50 with ramp member first end 40. Projections 52*a*, 52*b* may extend from a plane defined by tab 48 in a direction out of alignment with the plane and generally transverse to the plane in this embodiment. In one embodiment, first tab portion 50 with projections 52*a*, 52*b* extending therefrom forms a connector for coupling together a pair of ramp members 20, 22, in a manner to be described in detail later.

Referring to FIGS. 3 and 4, first projection 52*a* and second projection 52*b* are generally longitudinal in configuration. However, projections 52*a*, 52*b* may be formed in any desired configuration. In one embodiment, first and second projections 52*a*, 52*b* also extend generally perpendicular to ramp member longitudinal axis and are spaced a predetermined distance B apart. A third projection 56 may be incorporated into second tab portion 54. Third projection 56 may extend from the plane defined by tab 48 in a direction out of alignment with the plane and this embodiment is generally perpendicular to the plane and may form an acute angle with ramp member longitudinal axis A.

Figure 7:
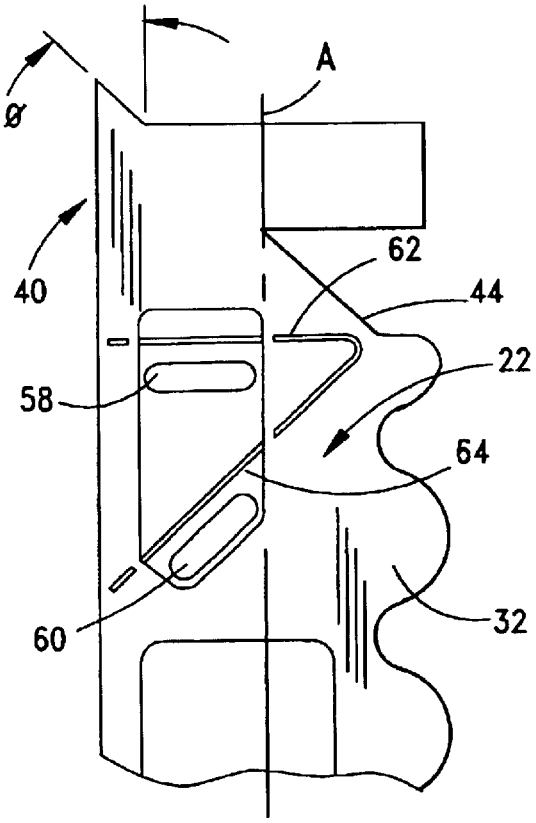
FIG. 7 is a partial bottom plan view of the bottom surface of a first end of a ramp member of the present invention.

Referring to FIG. 7, a pair of cavities 58, 60 are formed in bottom surface 32 proximate first end 40 of ramp member 22. Cavities 58, 60 are configured to receive either one of projections 52*a* or 52*b* extending from tab 48 of ramp member 20, in a manner to be described in detail later. It should be understood that cavities formed in bottom surface 32 of ramp member 22 generally extend into bottom surface 32 to a pre-determined depth to form a blind hole. However, any of the cavities formed in bottom surface 32 may extend completely through a body of ramp member 22 to form a through hole if desired. As cavities 58, 60 shown in FIG. 7 are adapted to receive either one of projections 52*a* or 52*b*, these cavities are correspondingly generally longitudinal. However, cavities 58, 60 may be formed in any shape suitable for receiving projections extending from tab 48.

As seen in FIG. 7, grooves 62, 64 may be formed in bottom side 32 of ramp member 22 proximate respective ones of cavities 58, 60 at ramp member first end 40. Grooves 62, 64 act as a guides for aligning a cutting tool for cutting off a portion of ramp member first end 40 along either of grooves 62, 64, for purposes to be described in detail later. Each of grooves 62, 64 is spaced apart from a respective cavity 58, 60 approximately one half of the predetermined distance B (FIG. 4) separating projections 52*a*, 52*b* on first tab portion 50.

Figure 8:
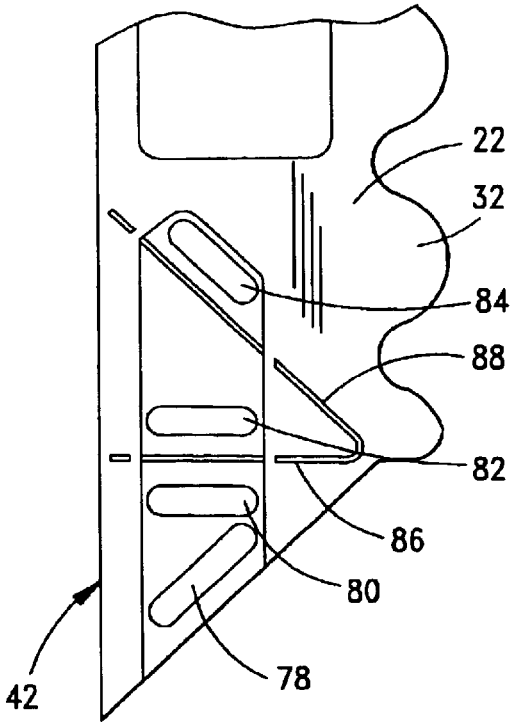
FIG. 8 is a partial bottom plan view of the bottom surface of a second end of a ramp member of the present invention.

Referring to FIG. 8, a series of cavities 78, 80, 82, 84 are formed in bottom surface 32 proximate ramp member second end 42. Cavities 80, 82, 84 are configured to receive therein either one of projections 52*a* or 52*b* extending from first tab portion 50 of tab 48. Cavity 78 is configured to receive therein projection 56 extending from tab 48. As cavities 80, 82, 84 shown in FIG. 8 are adapted to receive either one of projections 52*a* or 52*b*, these cavities are correspondingly generally longitudinal. However, cavities 78, 80, 82, 84 may be formed in any shape suitable for receiving projections extending from tab 48.

As seen in FIG. 8, grooves 86, 88 may be formed in bottom side 32 of ramp member 22 proximate respective ones of cavities 82, 84 at ramp member second end 42. Grooves 86, 88 act as a guides for aligning a cutting tool for cutting off a portion of ramp member second end 42 along either of grooves 86, 88, for purposes to be described in detail later. Each of grooves 86, 88 is spaced apart from a respective cavity 82, 84 approximately one half of the predetermined distance B separating projections 52*a*, 52*b* on first tab portion 50.

Methods of connecting multiple ramp members together to form a border extending around one or more outer edges of a mat will now be discussed.

Figure 9:
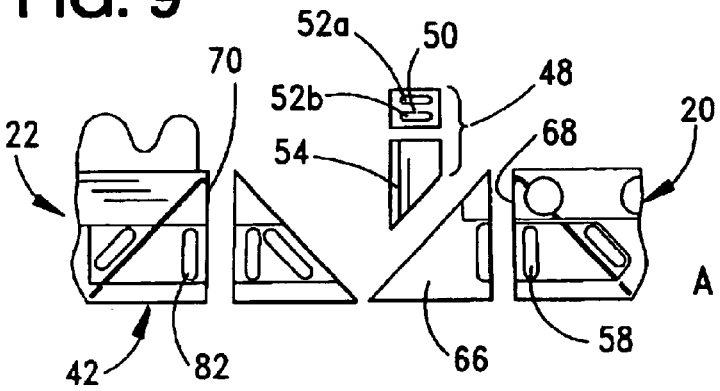
FIG. 9 is a partial bottom plan view of the first and second ends of separate ramp members of the present invention showing detachment of portions of the ramp members for forming an extended straight section comprising two adjacent ramp members.
Figure 9A:
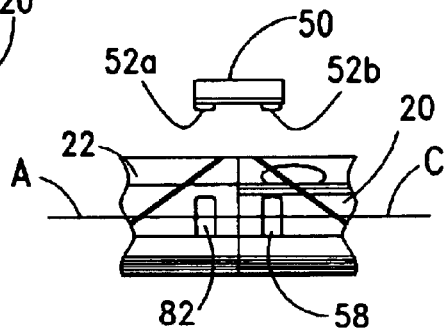
FIG. 9A is a partial bottom plan view of the first and second ends of separate ramp members of FIG. 9 abutting one another, and a tab portion for connecting the first and second ends together.

A pair of ramp members 20, 22 as described above may be connected to form an extended straight section (FIGS. 9, 9A). Alternatively, as seen in FIGS. 1, 10, 10A and 11, a second ramp member 22 may be connected to a first ramp member 20 such that longitudinal axis A of second ramp member 22 forms an angle with respect to longitudinal axis C of first ramp member 22, thereby forming a corner. This enables a border to be formed around mats having any one of a variety of shapes.

Generally, in order to ensure that ramp member edges positioned so as to abut each other have substantially the same length, ramp member edges which are to abut each other will be formed such that the angles that the abutting edges make with respective longitudinal axes of the ramp members are approximately the same. Alternatively, it may be desired, for purposes of forming an intersection defining a predetermined angle between two ramp members, to form adjacent ramp member abutting edges oriented at different angles with respect to their respective longitudinal axes.

Generally, for attachment to a first ramp member 20, a second ramp member 22 will be positioned such that a longitudinal axis A of second ramp member 22 forms a predetermined angle with a longitudinal axis C of first ramp member 20. One example is shown in FIG. 3.

A method for attaching two ramp members 20, 22 together to form an extended straight section will now be discussed. In this embodiment, the predetermined angle between the longitudinal axes of ramp members 20 and 22 is approximately 180 degrees. It is contemplated that the following description of cuts of the ramp members and corresponding portions can be done in a number of ways and order of cuts to obtain the desired result. The following is merely one way of accomplishing the desired result. Referring to FIGS. 3, 9, 9A, to form an extended straight section, tab 48 is cut from first end 66 of first ramp member 20. First tab portion 50 is separated from second tab portion 54 to form a connector. A portion of first ramp member first end 66 is cut off along groove 62 (see FIG. 7) to form a mating edge 68. Also, a portion of second ramp member second end 42 is cut off along groove 86 (see FIG. 8) to form a mating edge 70. First ramp member first end mating edge 68 and second ramp member second end mating edge 70 are then positioned adjacent each other. In the embodiment shown, mating edges 68 and 70 are positioned so as to actually abut each other (FIG. 9A). When mating edge 68 and mating edge 70 abut each other, cavity 58 formed in the bottom surface of first ramp member 20 (see FIG. 7) and cavity 82 formed in the bottom surface of second ramp member 22 (see FIG. 8) will reside adjacent each other. One of projections 52*a*, 52*b* of first tab portion/connector 50 is then inserted into cavity 58, and the remaining one of projections 52*a*, 52*b* is inserted into cavity 82, thereby coupling first member 20 and second member 22 together via first tab portion/connector 50.

Figure 11:
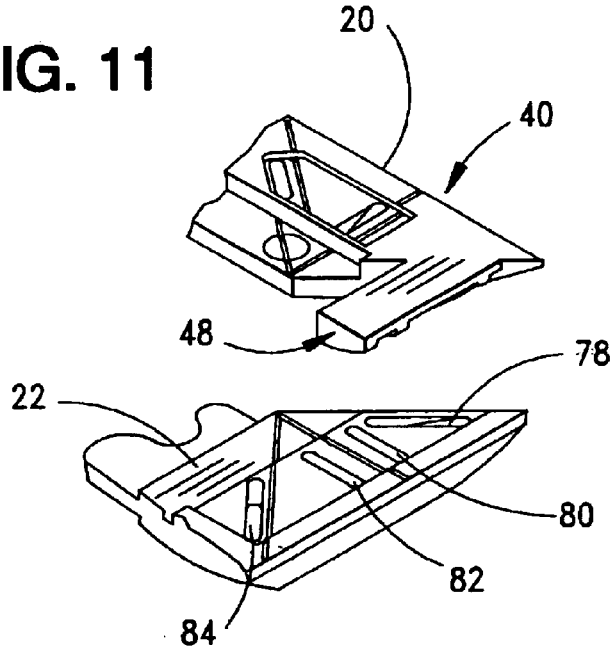
FIG. 11 is a plan view of the first and second ends of separate ramp members of the present invention showing connection of the ramp members ends to form an outside corner.

A method for attaching two ramp members 20, 22 together to form an outside corner bordering the mat will now be discussed and shown in FIG. 11. In this embodiment, tab 48 remains connected to first ramp member 20 and the predetermined angle between the longitudinal axes C and A of ramp members 20 and 22 respectively is approximately 90 degrees. Referring to FIGS. 3, 7, 8 and 11, to form an outside corner bordering the mat, projections 52*a*, 52*b* and 56 of tab 48 are inserted into cavities 82, 80 and 78, respectively, to join first ramp member 20 first end 66 and second ramp member 22 second end 42 together.

Figure 10:
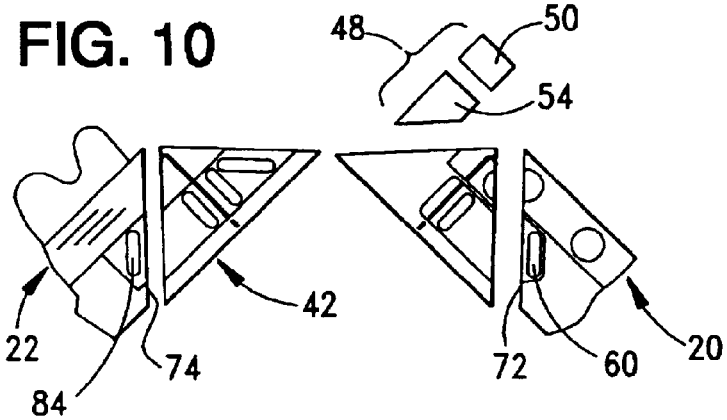
FIG. 10 is a partial bottom plan view of the first and second ends of separate ramp members of the present invention showing detachment of portions of the ramp members for forming an inside corner.
Figure 10A:
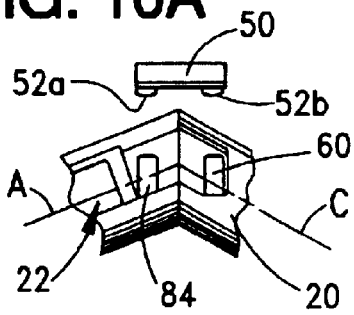
FIG. 10A is a partial bottom plan view of first and second ends of FIG. 10 abutting one another, and a tab portion for connecting the first and second ends of FIG. 10 together.

A method for attaching two ramp members 20, 22 together to form an inside corner will now be discussed and shown in FIGS. 10 and 10A. In this embodiment, the predetermined angle between the longitudinal axes of ramp members 20 and 22 is also approximately 90 degrees.

Again it is contemplated that the following description of cuts of the ramp members and corresponding portions can be done in a number of ways and order of cuts to obtain the desired result. The following is merely one way of accomplishing the desired result. Referring to FIGS. 3, 7, 8, 10 and 10A, to form an inside corner, tab 48 is cut from first ramp member first end 66. First tab portion 50 is then separated from second tab portion 54 to form a connector. A portion of first ramp member first end 66 is then cut off along groove 64 (FIG. 7) to form a mating edge 72. Also, a portion of second ramp member 22 second end 42 is cut off along groove 88 to form a mating edge 74. First member mating edge 72 and second member mating edge 74 are then positioned adjacent each other. In the embodiment shown, mating edges 72 and 74 are positioned so as to actually abut each other (FIG. 10A). When mating edge 72 and mating edge 74 abut each other, cavity 60 formed in the bottom surface of first ramp member 20 and cavity 84 formed in the bottom surface of second ramp member 22 will reside adjacent each other. One of projections 52*a*, 52*b* of first tab portion/connector 50 is then inserted into cavity 60, and the remaining one of projections 52*a*, 52*b* is inserted into cavity 84, thereby coupling first member 20 and second member 22 together via first tab portion/connector 50.

Thus, it may be seen from the methods described above that by appropriate trimming of a single, standardized ramp member piece, a variety of ramp configurations may be achieved. If it is desired to position first member first end 66 adjacent, but separated from, second member second end 42 when forming any of the ramp member configurations described above, the predetermined distance separating projections 52*a* and 52*b* of first tab portion 50 may be adjusted prior to fabrication of the ramp member to increase the predetermined separation distance between projections 52*a* and 52*b* in correspondence with the desired separation distance of the ramp member ends. First tab portion 50 is then used to connect second member 22 with first member 20 as previously described.

It should be understood that the preceding is merely a detailed description of one embodiment of this invention and that numerous changes to the disclosed embodiment can be made in accordance with the disclosure herein without departing from the spirit or scope of the invention. The preceding description, therefore, is not meant to limit the scope of the invention. Rather, the scope of the invention is to be determined only by the appended claims and their equivalents.

What is claimed is:

1. A ramp member adapted for attachment to an edge of a floor mat comprising:

a tab extending from the ramp member and defining a plane;

two projections extending from the plane of the tab out of alignment with the plane; and two cavities adapted for receiving therein at least one projections formed on a second ramp member for connecting the ramp member to the second ramp member.

2. The ramp member of claim 1 wherein the projections and the tab are generally transverse to one another.

3. The ramp member of claim 1 further comprising a third projection extending from the tab.

4. The ramp member of claim 3 wherein the ramp member includes a third cavity adapted for receiving therein at least one projection formed on the second ramp member.

5. The ramp member of claim 4 wherein the ramp member includes a fourth cavity adapted for receiving therein at least one projection formed on the second ramp member.

6. The ramp member of claim 5 further comprising a groove formed in a surface of the ramp member proximate the fourth cavity.

7. The ramp member of claim 6 wherein the two projections are spaced a predetermined distance apart and the groove is spaced apart from the at least one cavity approximately one half of the predetermined distance.

8. The ramp member of claim 3 wherein the tab further comprises a second tab portion from which the third projection extends.

9. The ramp member of claim 1 wherein a first end of the ramp member has an edge formed at an acute angle with respect to a longitudinal axis of the ramp member.

10. The ramp member of claim 9 wherein the first end angled edge extends at an angle of approximately 45 degrees with respect to a longitudinal axis of the ramp member.

11. The ramp member of claim 9 wherein the tab extends from the edge.

12. The ramp member of claim 1 wherein the tab extends from a first end of the ramp member.

13. The ramp member of claim 1 wherein the tab comprises a first tab portion from which the two projections extend.

14. The ramp member of claim 1 wherein the two projections are spaced a predetermined distance apart.

15. The ramp member of claim 14 further comprising a groove formed in a surface of the ramp member proximate one of the two cavities.

16. The ramp member of claim 15 wherein the groove is spaced apart from the cavity approximately one half of the predetermined distance.

17. The ramp member of claim 1 wherein the tab extends substantially perpendicular to a longitudinal axis of the ramp member.

18. The ramp member of claim 1 wherein a second end of the ramp member has an edge formed at an acute angle with respect to a longitudinal axis of the ramp member.

19. The ramp member of claim 18 wherein the second end angled edge extends at an angle of approximately 45 degrees with respect to a longitudinal axis of the ramp member.

20. A floor mat assembly comprising:

a floor mat; and a ramp system, adapted for attachment to the floor mat, including plurality of ramp members; wherein each ramp member includes a tab extending from the ramp member and defining a plane, two projections extending from the plane of the tab out of alignment with the plane; and two cavities positioned in the ramp member adapted for receiving therein at least one projection formed on the tab of a second ramp member within the plurality of ramp members for connecting the ramp member to the second ramp member.

21. The floor mat assembly of claim 20 wherein the projections and the tab are generally transverse to one another.

22. The floor mat assembly of claim 20 wherein each ramp member further comprises a third projection extending from the tab.

23. The floor mat assembly of claim 22 wherein each ramp member includes a third cavity adapted for receiving therein at least one projection formed on the tab of the second ramp member.

24. The floor mat assembly of claim 23 wherein each ramp member includes a fourth cavity adapted for receiving therein at least one projection formed on the tab of the second ramp member.

25. The floor mat assembly of claim 24 wherein each ramp member further comprising a groove formed in a surface of the ramp member proximate the fourth cavity.

26. The floor mat assembly of claim 22 wherein the tab of each ramp member further comprises a second tab portion from which the third projection extends.

27. The floor mat assembly of claim 20 wherein a first end of each ramp member has an edge formed at an acute angle with respect to a longitudinal axis of the ramp member.

28. The floor mat assembly of claim 27 wherein the first end angled edge of each ramp member extends at an angle of approximately 45 degrees with respect to a longitudinal axis of the ramp member.

29. The floor mat assembly of claim 27 wherein the tab of each ramp member extends from the edge of the ramp member.

30. The floor mat assembly of claim 20 wherein the tab of each ramp member extends from a first end of each ramp member.

31. The floor mat assembly of claim 20 wherein the tab of each ramp member comprises a first tab portion from which the two projections extend.

32. The floor mat assembly of claim 20 wherein the two projections of each ramp member are spaced a predetermined distance apart.

33. The floor mat assembly of claim 32 wherein each ramp member further comprises a groove formed in a surface of the ramp member proximate one of the two cavities.

34. The floor mat assembly of claim 33 wherein the groove in each ramp member is spaced apart from the cavity approximately one half of the predetermined distance.

35. The floor mat assembly of claim 20 wherein the tab of each ramp member extends substantially perpendicular to a longitudinal axis of each ramp member.

36. The floor mat assembly of claim 20 wherein a second end of each ramp member has an edge formed at an acute angle with respect to a longitudinal axis of the ramp member.

37. The floor mat assembly of claim 36 wherein the second end angled edge of each ramp member extends at an angle of approximately 45 degrees with respect to a longitudinal axis of the ramp member.

* * * * *

UNITED STATES PATENT AND TRADEMARK OFFICE

CERTIFICATE OF CORRECTION

PATENT NO. : 6,954,975 B2
DATED : October 18, 2005
INVENTOR(S) : Michael W. Dolinski It is certified that error appears in the above-identified patent and that said Letters Patent is hereby corrected as shown below:

Title page,
Item [75], Inventor, after "LaGrange" insert -- Park --.

Signed and Sealed this

Eighteenth Day of April, 2006

JON W. DUDAS
*Director of the United States Patent and Trademark Office*